US009687970B2

(12) United States Patent
Chen

(10) Patent No.: US 9,687,970 B2
(45) Date of Patent: Jun. 27, 2017

(54) OIL CORE WRENCH

(71) Applicant: Plus Craft Industrial Co., Ltd., Taichung (TW)

(72) Inventor: Timmy Chen, Taichung (TW)

(73) Assignee: Plus Craft Industrial Co., Ltd., Taichung (TW)

( * ) Notice: Subject to any disclaimer, the term of this patent is extended or adjusted under 35 U.S.C. 154(b) by 0 days.

(21) Appl. No.: 14/833,183

(22) Filed: Aug. 24, 2015

(65) Prior Publication Data

US 2017/0057059 A1 Mar. 2, 2017

(51) Int. Cl.
*B25B 13/48* (2006.01)
*B25B 27/00* (2006.01)
*B25B 13/50* (2006.01)

(52) U.S. Cl.
CPC ..... *B25B 13/481* (2013.01); *B25B 13/5008* (2013.01); *B25B 27/0042* (2013.01)

(58) Field of Classification Search
CPC ..... B25B 13/481; B25B 13/5008; B25B 27/0042
USPC ..... 81/65; 7/100, 139
See application file for complete search history.

(56) References Cited

U.S. PATENT DOCUMENTS 1,456,126 A * 5/1923 Friday ..... B67B 7/186 81/3.43
2,094,238 A * 9/1937 Koenig ..... B25B 1/205 81/65
2,498,582 A * 2/1950 Schoenberger ..... B25B 13/52 81/3.43
2,834,238 A * 5/1958 Stover, Sr. ..... B25B 13/52 81/361
3,064,325 A * 11/1962 Nester ..... B01L 9/50 24/134 R
3,859,694 A * 1/1975 Lafond ..... H02G 1/02 24/271
5,833,224 A * 11/1998 Holte ..... B25B 1/205 269/130
6,196,090 B1 * 3/2001 Dumont ..... B25B 13/52 81/64
7,493,719 B2 * 2/2009 Lackey ..... F41A 23/04 211/64
8,316,740 B2 * 11/2012 Idir ..... B25B 13/52 81/3.43
8,517,732 B2 * 8/2013 Segal ..... A61C 5/125 433/155
9,205,540 B2 * 12/2015 Lin ..... B25B 13/52

* cited by examiner

*Primary Examiner* — Larry E Waggle, Jr.
*Assistant Examiner* — Danny Hong
(74) *Attorney, Agent, or Firm* — Alan D. Kamrath; Kamrath IP Lawfirm, P.A.

(57) ABSTRACT

An oil core wrench includes a oneway control unit, a wrench unit and a rotation handle. The wrench unit includes a threaded rod, an adjusting member, a base member and a clamping member. The oneway control unit is mounted in the base member and includes a control member. Thus, the oil core is clamped between the clamping member of the wrench unit and the control member of the oneway control unit so that the wrench unit can drive the oil core to rotate successively in a oneway manner by operation of the oneway control unit, so as to tighten or loosen the oil core easily and quickly. In addition, the oil core wrench can be operated in a narrow or small working region.

6 Claims, 18 Drawing Sheets

OIL CORE WRENCH

BACKGROUND OF THE INVENTION

1. Field of the Invention

The present invention relates to a hand tool and, more particularly, to an oil core wrench.

2. Description of the Related Art

A conventional oil core wrench 1 in accordance with the prior art shown in FIGS. 1-3 comprises a threaded rod 12, a non-rotation member 11 mounted on the upper end of the threaded rod 12 by a screw member 111, a rotation handle 2 mounted on the lower end of the threaded rod 12 by a screw member 21 which is screwed into a screw bore formed in the lower end of the threaded rod 12, a nut 13 screwed onto the threaded rod 12, and a clamping member 14 extending through the non-rotation member 11 and connected with the nut 13. The clamping member 14 has two distal ends extending through the non-rotation member 11 and secured to the nut 13 by two screw members 132. Each of the two distal ends of the clamping member 14 is provided with an aperture 141 to allow passage of one of the two screw members 132. The nut 13 is provided with two screw holes 131, and the two screw members 132 are respectively screwed into the two screw holes 131 of the nut 13 so that the clamping member 14 is secured to the nut 13. In operation, the clamping member 14 is mounted on an outer diameter of an oil core. When the rotation handle 2 is rotated along a vertical axis, the threaded rod 12 is rotated so that the nut 13 is moved downward, and the clamping member 14 is also moved downward to shorten the inner diameter of the clamping member 14. When the outer diameter of the oil core is sandwiched and clamped between the inner diameter of the clamping member 14 and the top of the non-rotation member 11, the rotation handle 2 stops rotating. When the rotation handle 4 is turned along a horizontal axis, the threaded rod 12 and the non-rotation member 11 are turned in concert with the rotation handle 2 so as to rotate the oil core. Thus, the oil core wrench 1 can drive the oil core to rotate in the clockwise direction so as to tighten the oil core or to rotate in the counterclockwise direction so as to loosen the oil core. When the oil core is mounted in a narrow region, such as an engine, there is not much space to allow movement of the rotation handle 2, so that it is necessary for the oil core wrench 1 to drive and rotate the oil core in a oneway manner. However, the conventional oil core wrench 1 does not have a oneway operation function so that the conventional oil core wrench 1 cannot be operated easily and quickly in the narrow region, thereby greatly causing inconvenience to the operator and increasing the working time.

BRIEF SUMMARY OF THE INVENTION

The primary objective of the present invention is to provide an oil core wrench that is operated in a oneway manner.

In accordance with the present invention, there is provided an oil core wrench comprising a oneway control unit, a wrench unit and a rotation handle. The wrench unit includes a threaded rod having a first end connected with the oneway control unit, an adjusting member mounted on the threaded rod, a base member connected with the oneway control unit, and a clamping member extending through the base member and connected with the adjusting member. The base member is provided with a receiving recess and two passages. The receiving recess of the base member is located between the two passages and has a first side provided with a resting wall and a second side provided with a receiving space. The clamping member has two distal ends extending through the passages of the base member and secured to the adjusting member. The oneway control unit is received in the receiving recess of the base member and mounted on the first end of the threaded rod. The rotation handle is secured on a second end of the threaded rod.

According to the primary advantage of the present invention, the oil core is clamped between the clamping member of the wrench unit and the control member of the oneway control unit so that the wrench unit can drive the oil core to rotate successively in a oneway manner by operation of the oneway control unit, so as to tighten or loosen the oil core easily and quickly.

According to another advantage of the present invention, the wrench unit drives the oil core to rotate successively without having to remove the clamping member from the oil core, so that the oil core wrench can be operated in a narrow or small working region.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
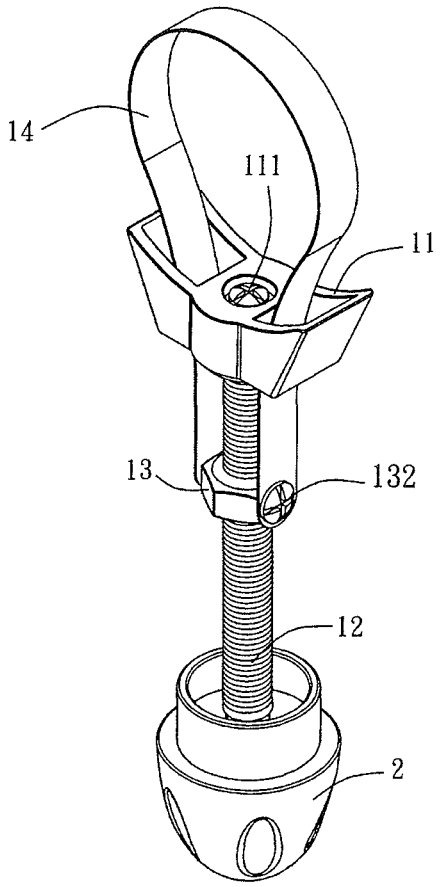
FIG. 1 PRIOR ART
FIG. 1 is a perspective view of a conventional oil core wrench in accordance with the prior art.
Figure 2:
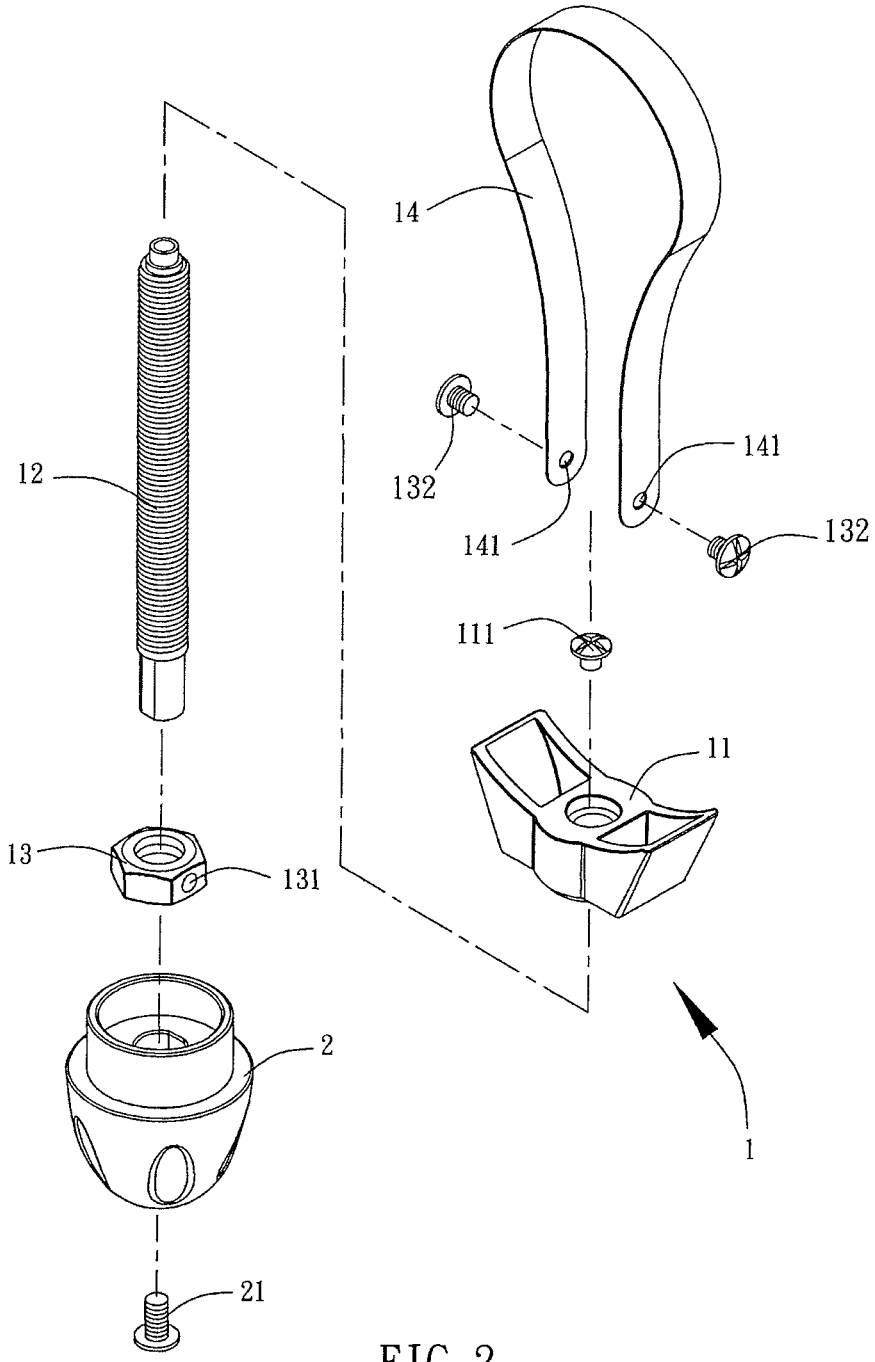
FIG. 2 PRIOR ART
FIG. 2 is an exploded perspective view of the conventional oil core wrench as shown in FIG. 1.
Figure 3:
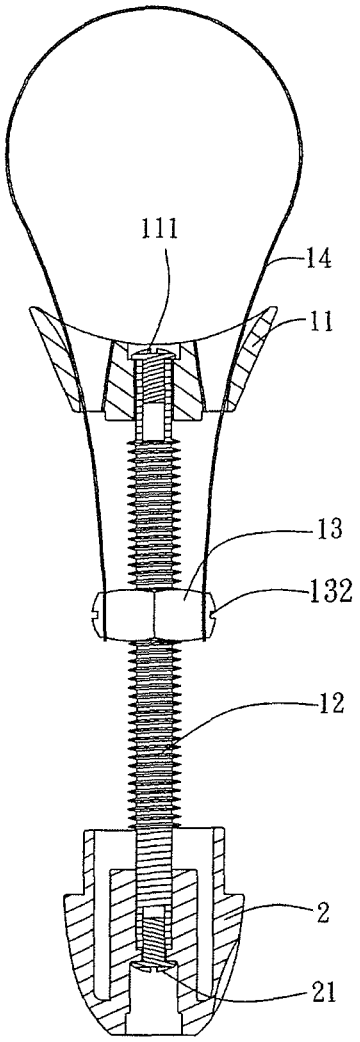
FIG. 3 PRIOR ART
FIG. 3 is a cross-sectional view of the conventional oil core wrench as shown in FIG. 1.
Figure 4:
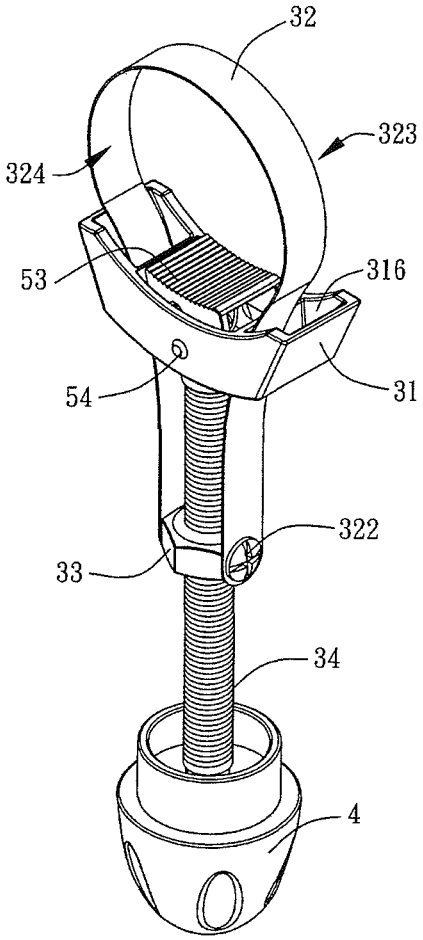
FIG. 4 is a perspective view of an oil core wrench in accordance with the preferred embodiment of the present invention.
Figure 5:
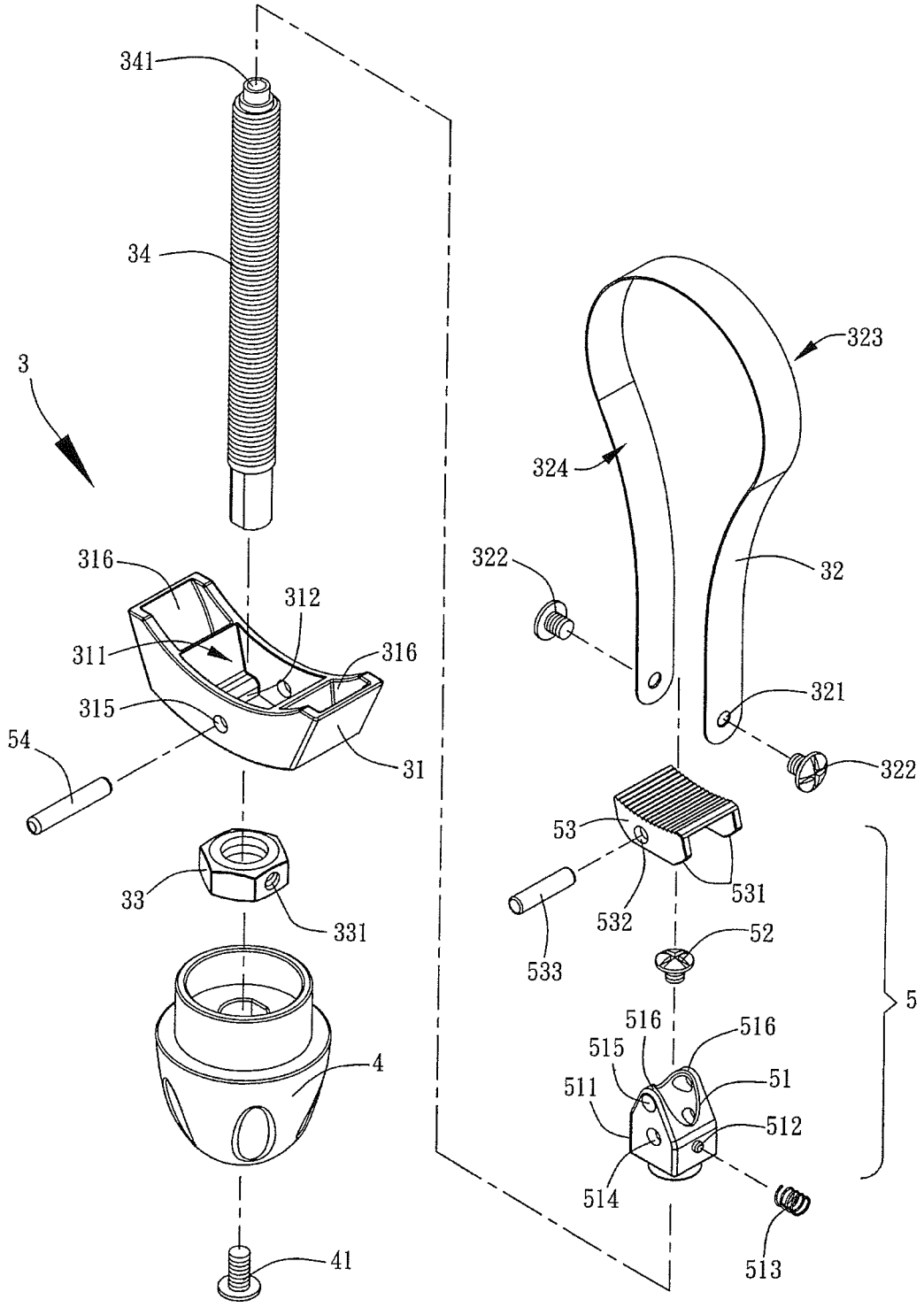
FIG. 5 is an exploded perspective view of the oil core wrench as shown in FIG. 4.
Figure 6:
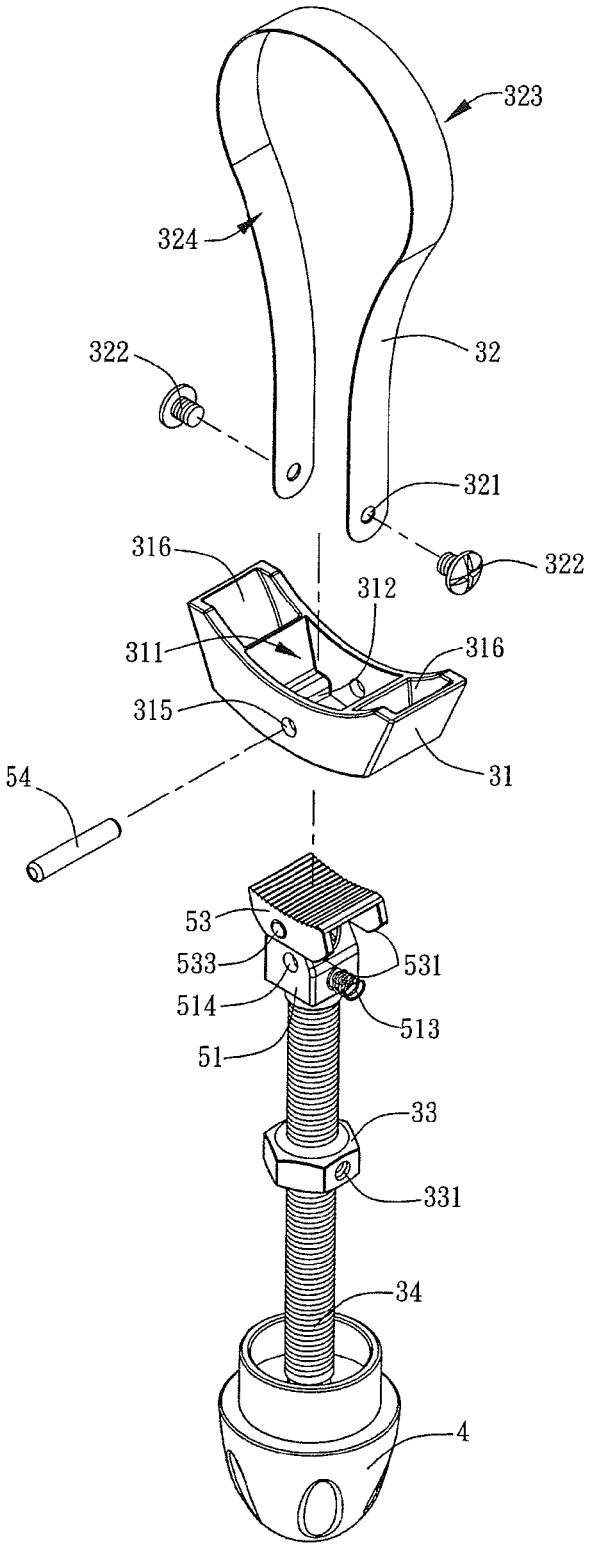
FIG. 6 is a partially exploded perspective view of the oil core wrench as shown in FIG. 4.
Figure 7:
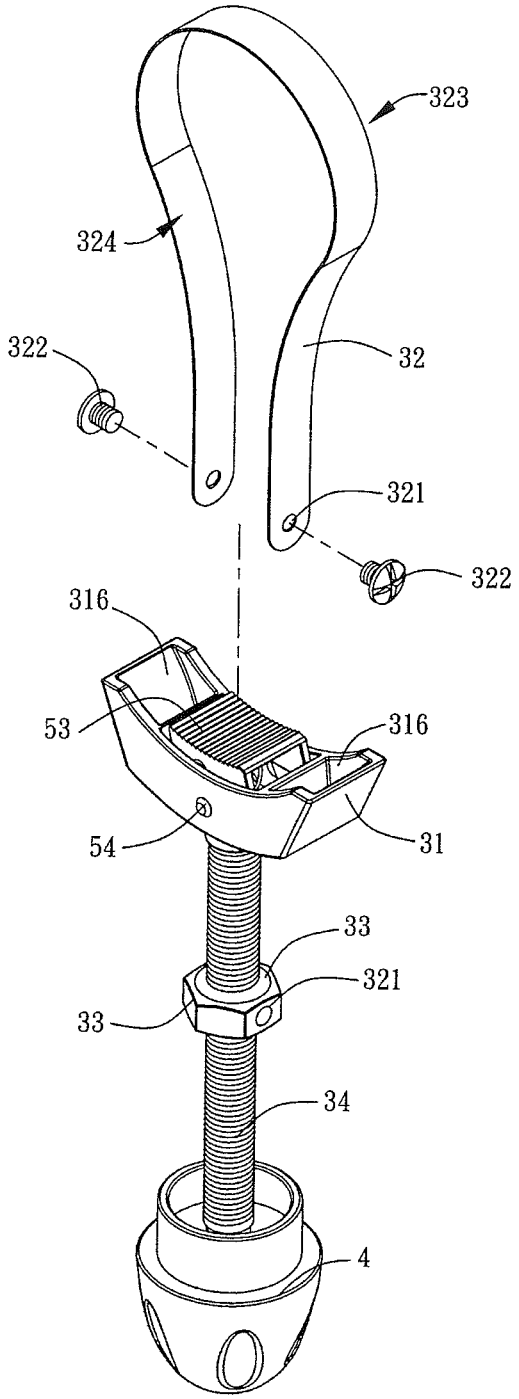
FIG. 7 is a partially exploded perspective view of the oil core wrench as shown in FIG. 4.
Figure 8:
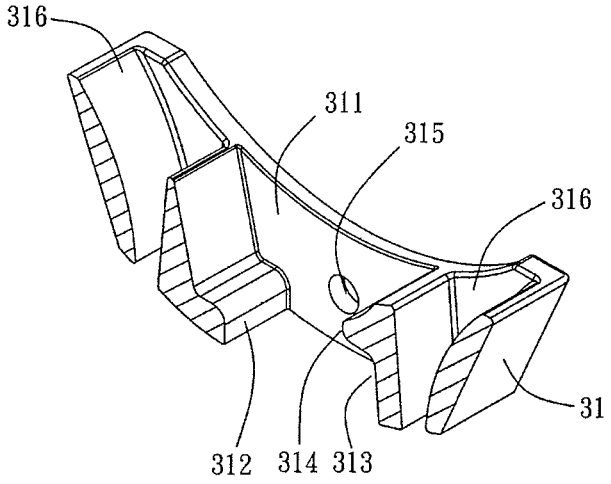
FIG. 8 is a perspective cross-sectional view of a base member of the oil core wrench in accordance with the preferred embodiment of the present invention.
Figure 9:
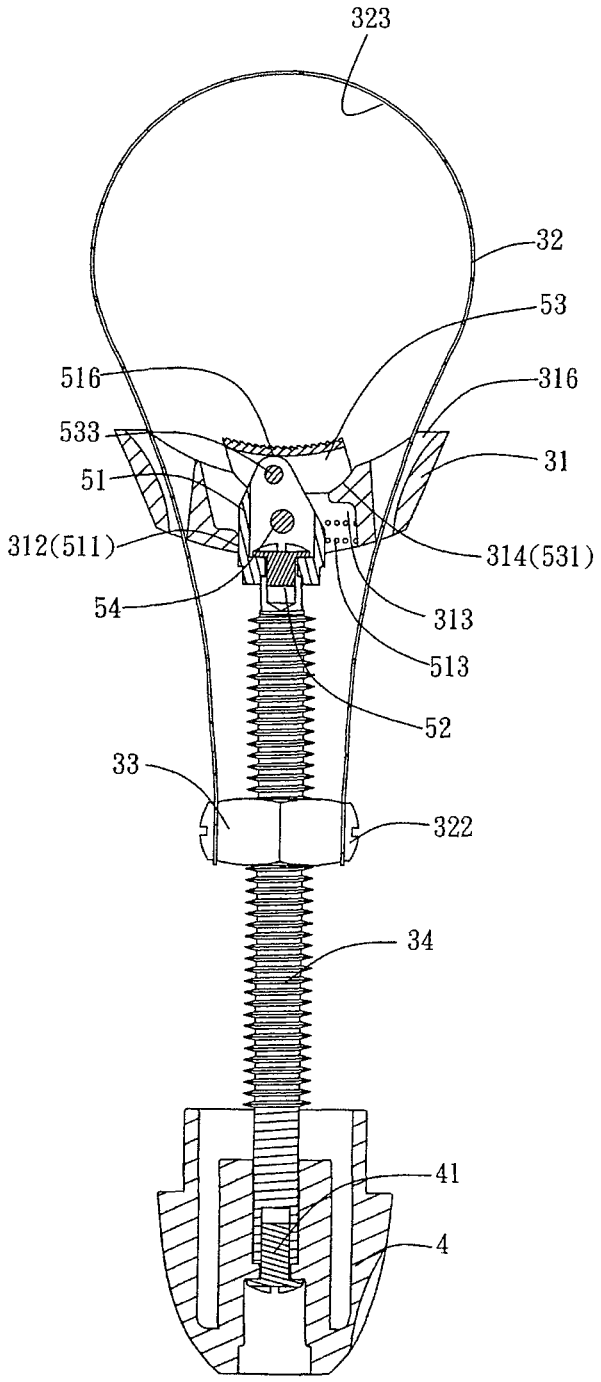
FIG. 9 is a cross-sectional view of the oil core wrench as shown in FIG. 4.

Referring to the drawings and initially to FIGS. 4-9, an oil core wrench in accordance with the preferred embodiment of the present invention comprises a oneway control unit 5, a wrench unit 3 and a rotation handle 4.

The wrench unit 3 includes a threaded rod 34 having a first end 341 connected with the oneway control unit 5, an adjusting member 33 mounted on the threaded rod 34, a base member 31 connected with the oneway control unit 5, and a clamping member 32 extending through the base member 31 and connected with the adjusting member 33. The base member 31 is provided with a receiving recess 311 and two passages 316. The receiving recess 311 of the base member 31 is located between the two passages 316 and has a first side provided with a resting wall 312 and a second side provided with a receiving space 313. The receiving space 313 of the base member 31 has an upper portion provided with a resting wall 314. The base member 31 is further provided with a through hole 315 connected to and transversely extending through the receiving recess 311. The clamping member 32 has two distal ends extending through the passages 316 of the base member 31 and secured to the adjusting member 33 by two screw members 322. Each of the two distal ends of the clamping member 32 is provided with an aperture 321 to allow passage of one of the two screw members 322. The clamping member 32 has a first end provided with a first entrance 323 and a second end provided with a second entrance 324. The adjusting member 33 is a nut which is screwed onto the threaded rod 34. The adjusting member 33 is provided with two screw holes 331, and the two screw members 322 are respectively screwed into the two screw holes 331 of the adjusting member 33 so that the clamping member 32 is secured to the adjusting member 33.

The oneway control unit 5 is received in the receiving recess 311 of the base member 31 and mounted on the first end 341 of the threaded rod 34. The oneway control unit 5 includes a control member 51 mounted on the first end 341 of the threaded rod 34 by a screw member 52 and having a first side provided with a drive portion 511 abutting the resting wall 312 of the base member 31 and a second side provided with a mounting portion 512, a shaft 54 extending through the base member 31 and the control member 51, a toothed member 53 mounted on the control member 51, a mandrel 533 extending through the toothed member 53 and the control member 51, and an elastic member 513 mounted on the mounting portion 512 of the control member 51. The control member 51 has a top provided with a push portion 516 abutting an inner top edge of the toothed member 53. The control member 51 is provided with a transverse bore 514, and the shaft 54 extends through the through hole 315 of the base member 31 and the transverse bore 514 of the control member 51 so that the control member 51 is pivotally mounted in the receiving recess 311 of the base member 31. The control member 51 is further provided with a transverse hole 515. The elastic member 513 has a first end mounted on the mounting portion 512 of the control member 51 and a second end abutting an inner wall of the receiving space 313 of the base member 31. The toothed member 53 is located above the control member 51 and received in the receiving recess 311 of the base member 31. The toothed member 53 has a toothed top surface. The toothed member 53 is provided with a through aperture 532, and the mandrel 533 extends through the through aperture 532 of the toothed member 53 and the transverse hole 515 of the control member 51 so that the toothed member 53 is pivotally mounted on the control member 51. The toothed member 53 has a side provided with an abutting portion 531 abutting the resting wall 314 of the base member 31.

The rotation handle 4 is secured on a second end of the threaded rod 34 by a screw member 41 which is screwed into a screw bore formed in the second end of the threaded rod 34.

Figure 10:
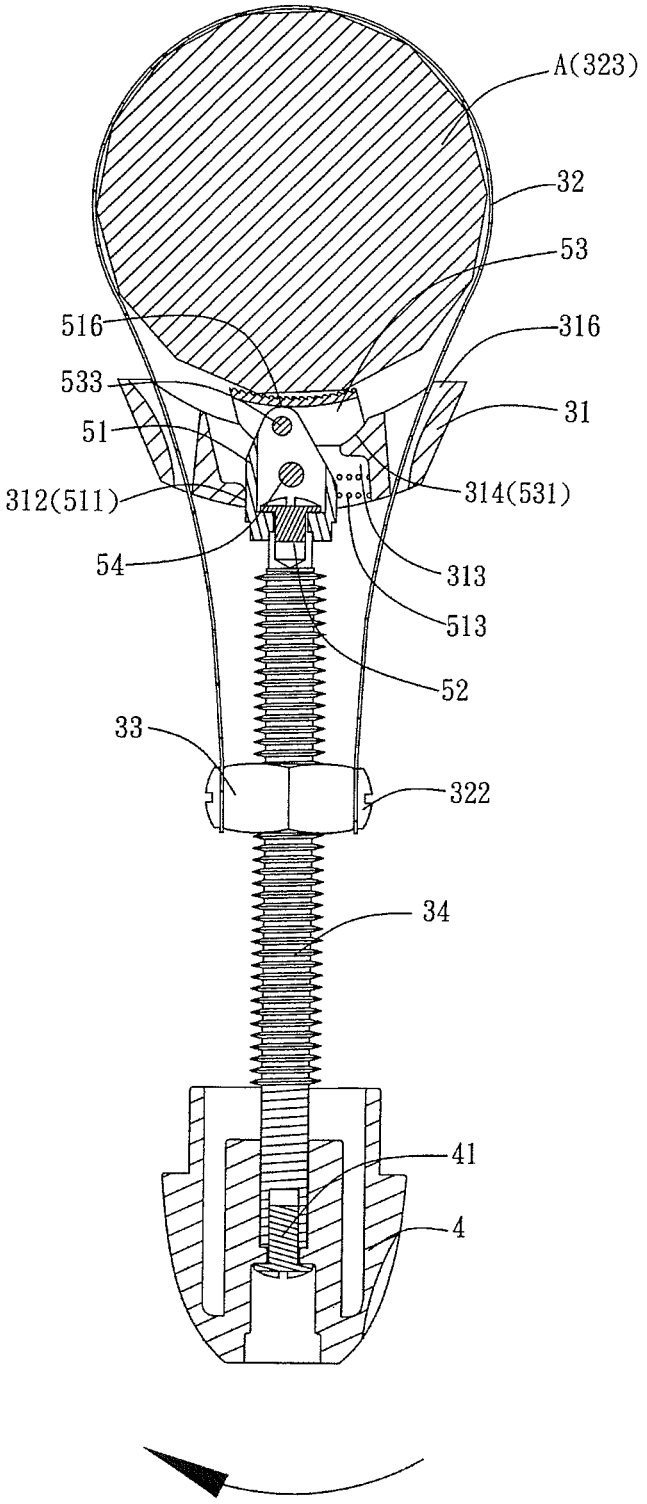
FIG. 10 is a schematic operational view of the oil core wrench as shown in FIG. 9.
Figure 11:
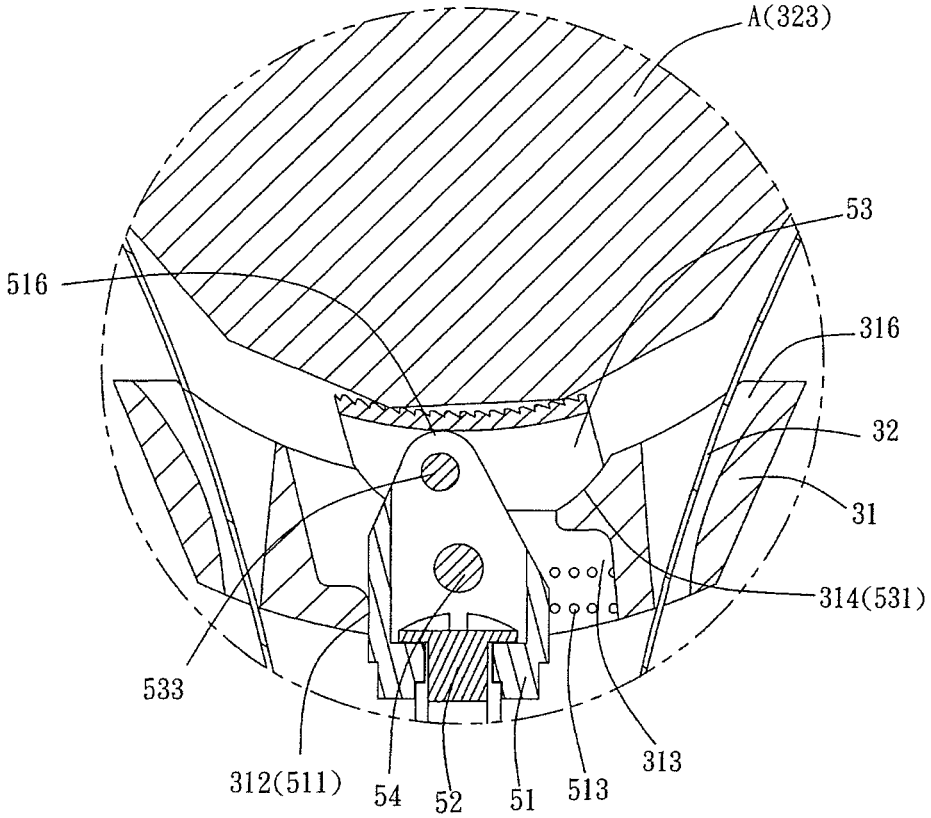
FIG. 11 is a locally enlarged view of the oil core wrench as shown in FIG. 10.

In operation, referring to FIGS. 10-13 with reference to FIGS. 4-9, the first entrance 323 of the clamping member 32 of the wrench unit 3 is mounted on an outer diameter of an oil core "A". When the rotation handle 4 is rotated along a vertical axis, the threaded rod 34 is rotated so that the adjusting member 33 is moved downward, and the clamping member 32 is also moved downward to shorten the inner diameter of the clamping member 32. When the outer diameter of the oil core "A" is sandwiched between the inner diameter of the clamping member 32 and the top of the toothed member 53, the rotation handle 4 stops rotating. When the rotation handle 4 is turned in the clockwise direction as shown in FIG. 10, the threaded rod 34 and the control member 51 are turned in concert with the rotation handle 4. At this time, the drive portion 511 of the control member 51 abuts the resting wall 312 of the base member 31, so that the base member 31 is moved with the control member 51. At the same time, the abutting portion 531 of the toothed member 53 abuts the resting wall 314 of the base member 31, so that the toothed member 53 is moved with the base member 31. In addition, the push portion 516 of the control member 51 abuts and pushes the inner top edge of the toothed member 53 so that the toothed top surface of the toothed member 53 engage the outer diameter of the oil core "A" as shown in FIG. 11. In such a manner, the outer diameter of the oil core "A" is clamped between the inner diameter of the clamping member 32 and the top of the toothed member 53, so that the oil core "A" is rotated in the clockwise direction toward a tightened state.

Figure 12:
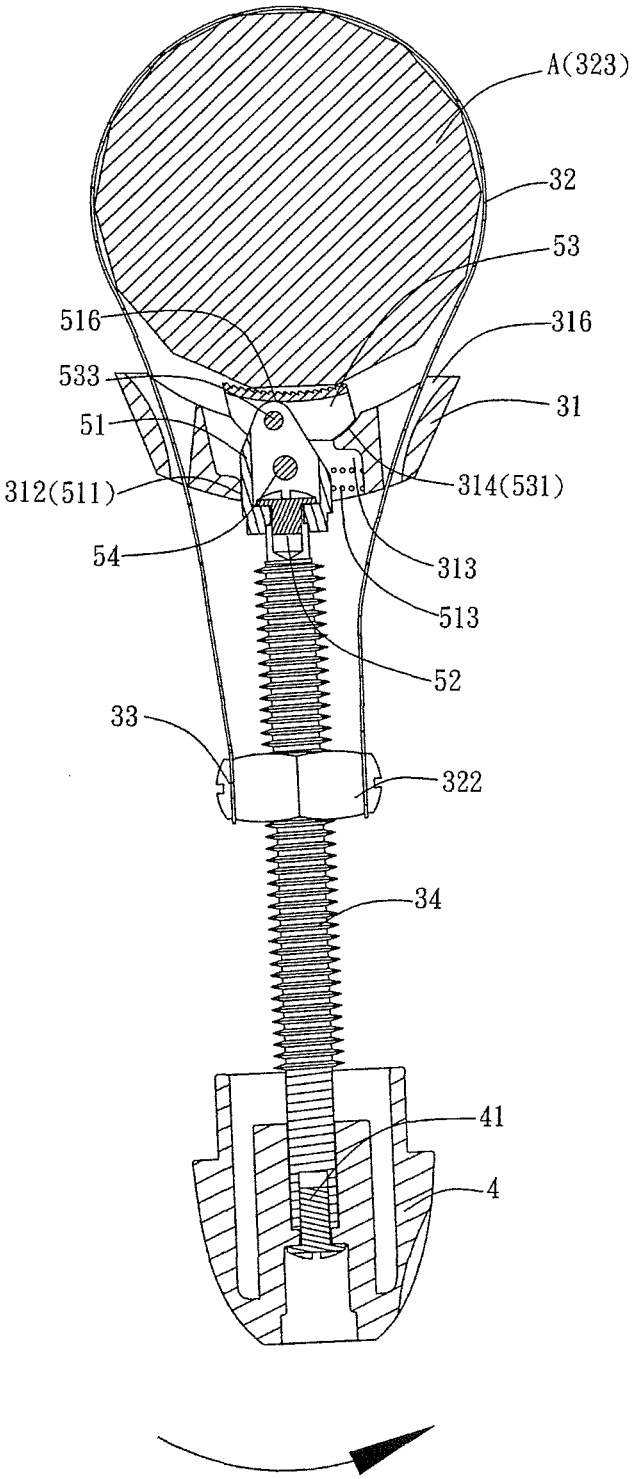
FIG. 12 is a schematic operational view of the oil core wrench as shown in FIG. 9.
Figure 13:
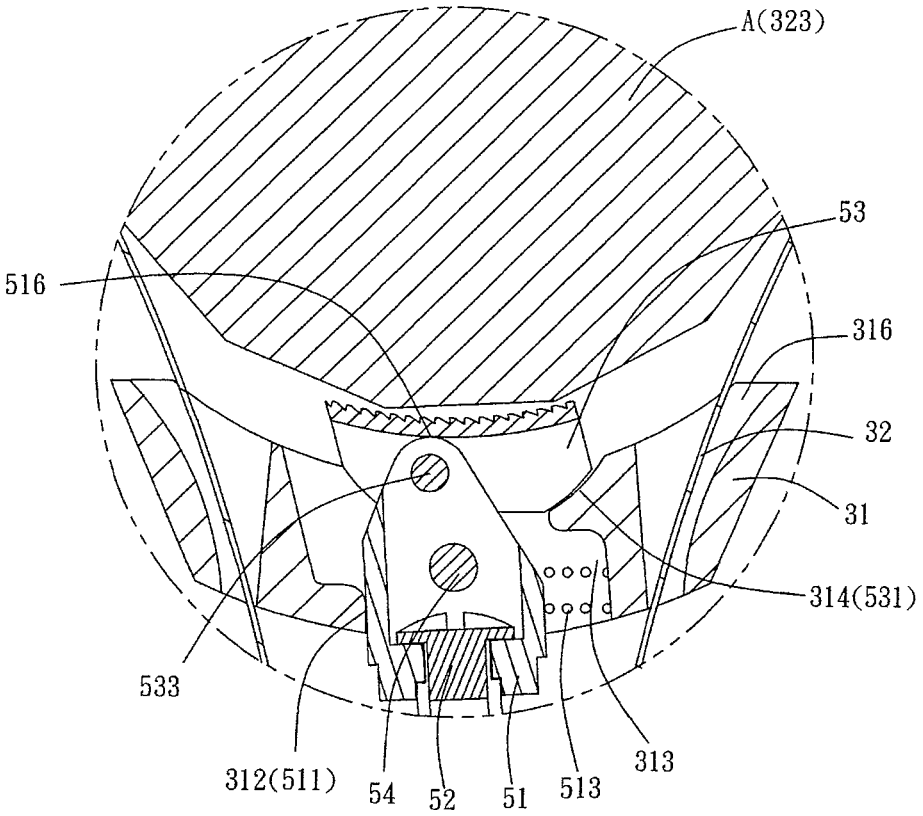
FIG. 13 is a locally enlarged view of the oil core wrench as shown in FIG. 12.

When the rotation handle 4 is turned in the counterclockwise direction as shown in FIG. 12, the control member 51 is pivoted about the shaft 54 and is moved toward the receiving space 313 of the base member 31, so that the push portion 516 of the control member 51 does not abut and push the inner top edge of the toothed member 53 any more. In such a manner, the toothed top surface of the toothed member 53 disengages the oil core "A" as shown in FIG. 13 so that the oil core "A" is not rotated, and the rotation handle 4 performs an idle rotation. Thus, when the wrench unit 3 is rotated in the clockwise direction as shown in FIG. 10, the oil core "A" is rotated with the wrench unit 3, and when the wrench unit 3 is rotated in the counterclockwise direction as shown in FIG. 12, the oil core "A" is not rotated with the wrench unit 3, so that the wrench unit 3 performs an idle rotation in the counterclockwise direction. Therefore, when the wrench unit 3 is rotated successively, the oil core "A" is rotated in one direction (for example, the clockwise direction) only, so that the wrench unit 3 performs a oneway rotation to drive the oil core "A" successively without having to adjust the rotation handle 4. Thus, the oil core wrench drives the oil core "A" to rotate successively in the clockwise direction only so as to tighten the oil core "A".

Figure 14:
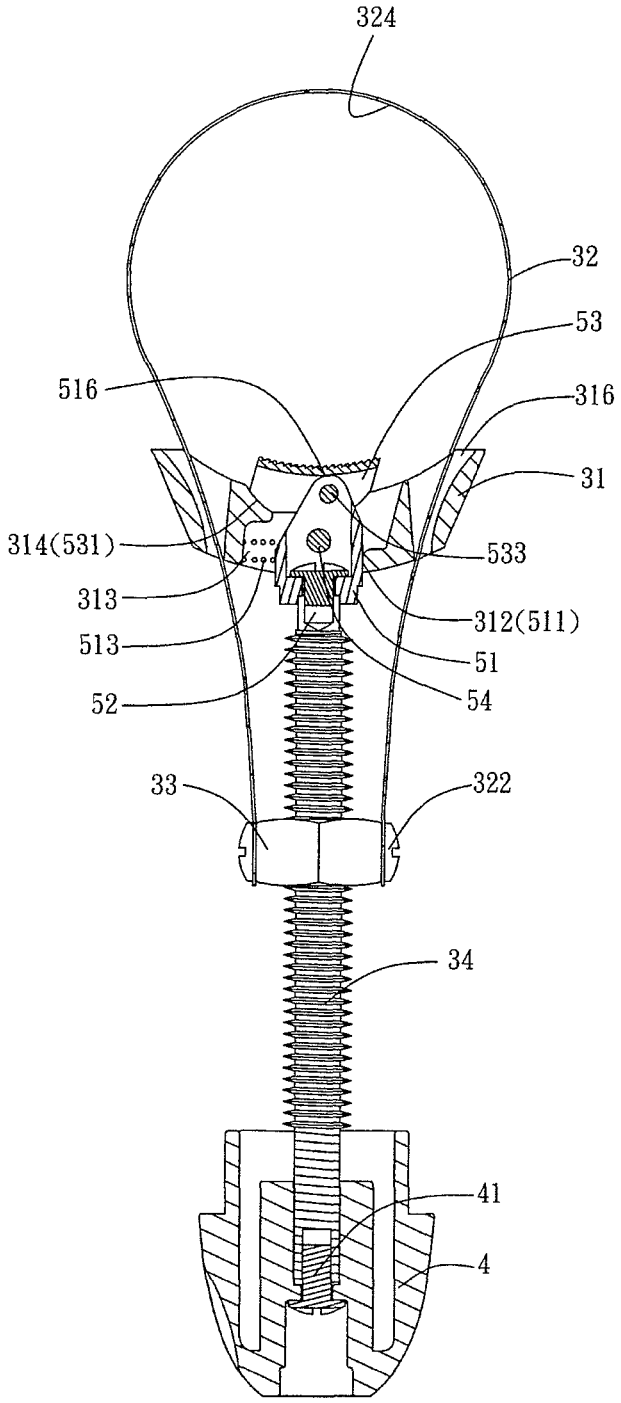
FIG. 14 is an inverted view of the oil core wrench as shown in FIG. 9.

Referring to FIG. 14 with reference to FIGS. 4-13, the second entrance 324 of the clamping member 32 of the wrench unit 3 is mounted on the outer diameter of the oil core "A". In such a manner, when the wrench unit 3 is rotated in the counterclockwise direction, the oil core "A" is rotated with the wrench unit 3, and when the wrench unit 3 is rotated in the clockwise direction, the oil core "A" is not rotated with the wrench unit 3, so that the wrench unit 3 performs an idle rotation in the clockwise direction. Therefore, the oil core wrench drives the oil core "A" to rotate successively in the counterclockwise direction only so as to loosen the oil core "A".

Figure 15:
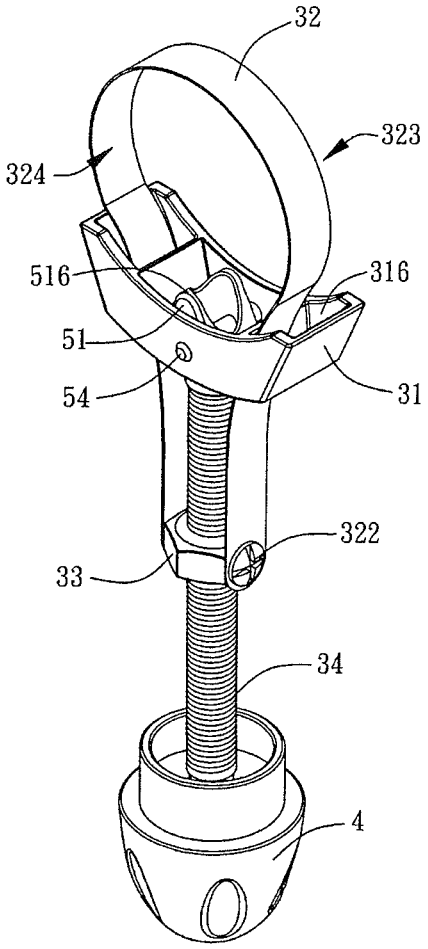
FIG. 15 is a perspective view of an oil core wrench in accordance with another preferred embodiment of the present invention.
Figure 16:
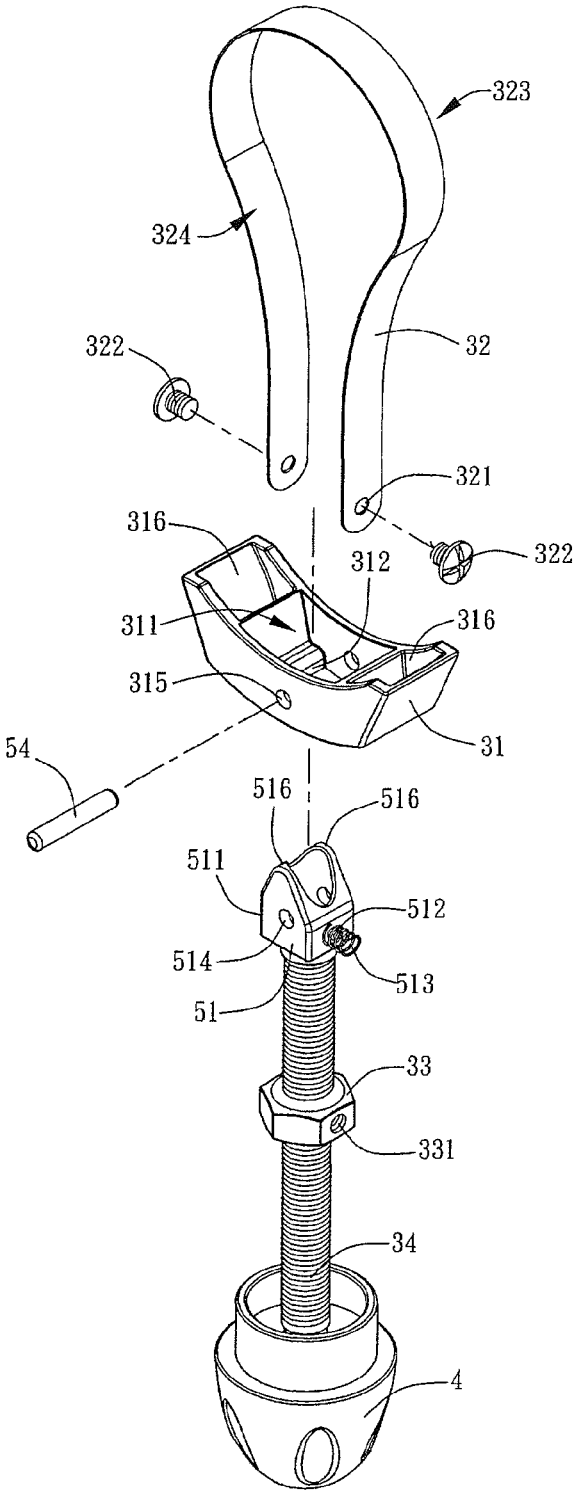
FIG. 16 is an exploded perspective view of the oil core wrench as shown in FIG. 15.
Figure 17:
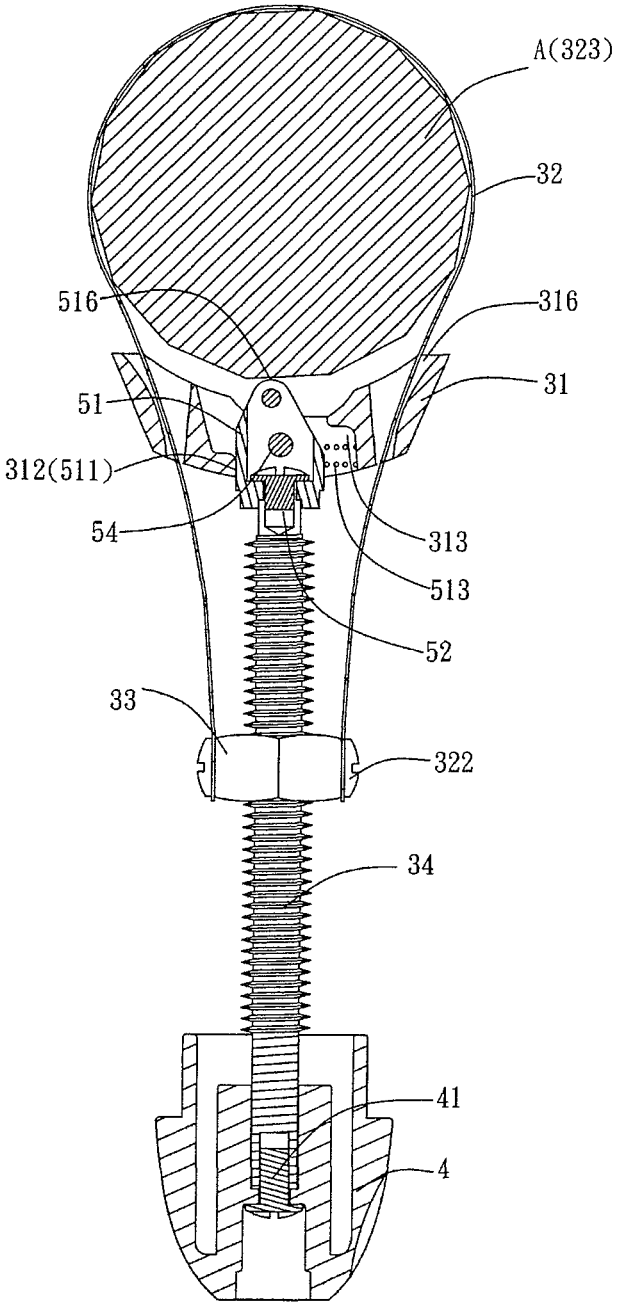
FIG. 17 is a cross-sectional view of the oil core wrench as shown in FIG. 15.

Referring to FIGS. 15-17 with reference to FIGS. 4-9, the toothed member 53 is removed, and the push portion 516 of the control member 51 directly abuts and pushes the outer diameter of the oil core "A", so that the outer diameter of the oil core "A" is clamped between the inner diameter of the clamping member 32 and the push portion 516 of the control member 51.

In operation, the first entrance 323 of the clamping member 32 of the wrench unit 3 is mounted on the outer diameter of the oil core "A". When the rotation handle 4 is rotated along a vertical axis, the threaded rod 34 is rotated so that the adjusting member 33 is moved downward, and the clamping member 32 is also moved downward to shorten the inner diameter of the clamping member 32. When the outer diameter of the oil core "A" is sandwiched between the inner diameter of the clamping member 32 and the push portion 516 of the control member 51, the rotation handle 4 stops rotating. When the rotation handle 4 is turned in the clockwise direction, the threaded rod 34 and the control member 51 are turned in concert with the rotation handle 4. At this time, the drive portion 511 of the control member 51 abuts the resting wall 312 of the base member 31, so that the base member 31 is moved with the control member 51. In such a manner, the outer diameter of the oil core "A" is clamped between the inner diameter of the clamping member 32 and the push portion 516 of the control member 51, so that the oil core "A" is rotated in the clockwise direction toward a tightened state.

When the rotation handle 4 is turned in the counterclockwise direction, the control member 51 is pivoted about the shaft 54 and is moved toward the receiving space 313 of the base member 31, so that the push portion 516 of the control member 51 does not abut and push the outer diameter of the oil core "A" any more. In such a manner, the push portion 516 of the control member 51 disengages the oil core "A" so that the oil core "A" is not rotated, and the rotation handle 4 performs an idle rotation. Thus, when the wrench unit 3 is rotated in the clockwise direction, the oil core "A" is rotated with the wrench unit 3, and when the wrench unit 3 is rotated in the counterclockwise direction, the oil core "A" is not rotated with the wrench unit 3, so that the wrench unit 3 performs an idle rotation in the counterclockwise direction.

Figure 18:
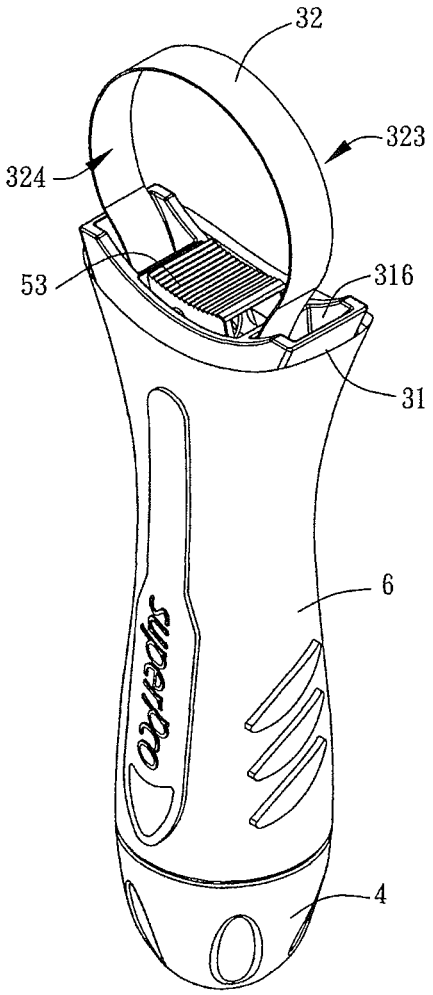
FIG. 18 is a perspective view of an oil core wrench in accordance with a further preferred embodiment of the present invention.

Referring to FIG. 18, the oil core wrench further comprises a handgrip 6 mounted between the base member 31 and the rotation handle 4.

Accordingly, the oil core "A" is clamped between the clamping member 32 of the wrench unit 3 and the control member 51 of the oneway control unit 5 so that the wrench unit 3 can drive the oil core "A" to rotate successively in a oneway manner by operation of the oneway control unit 5, so as to tighten or loosen the oil core "A" easily and quickly. In addition, the wrench unit 3 drives the oil core "A" to rotate successively without having to remove the clamping member 32 from the oil core "A", so that the oil core wrench can be operated in a narrow or small working region.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An oil core wrench comprising:

a oneway control unit, a wrench unit and a rotation handle; wherein:

the wrench unit includes:

a threaded rod having a first end connected with the oneway control unit;

an adjusting member mounted on the threaded rod;

a base member connected with the oneway control unit; and a clamping member extending through the base member and connected with the adjusting member;

the base member is provided with a receiving recess and two passages;

the receiving recess of the base member has a first side provided with a resting wall and a second side provided with a receiving space;

the clamping member has two distal ends extending through the two passages of the base member and secured to the adjusting member;

the oneway control unit is received in the receiving recess of the base member and mounted on the first end of the threaded rod;

the rotation handle is secured on a second end of the threaded rod;

the oneway control unit includes:

a control member mounted on the first end of the threaded rod and having a first side provided with a drive portion abutting the resting wall of the base member and a second side provided with a mounting portion;

a toothed member mounted on the control member; and an elastic member mounted on the mounting portion of the control member; and the control member has a top provided with a push portion abutting an inner top edge of the toothed member;

the oneway control unit further includes a mandrel extending through the toothed member and the control member;

the control member is provided with a transverse hole;

the toothed member is provided with a through aperture; and the mandrel extends through the through aperture of the toothed member and the transverse hole of the control member so that the toothed member is pivotally mounted on the control member.

2. The oil core wrench of claim 1, wherein the elastic member has a first end mounted on the mounting portion of the control member and a second end abutting an inner wall of the receiving space of the base member.

3. The oil core wrench of claim 1, wherein the toothed member has a toothed top surface.

4. An oil core wrench comprising:

a oneway control unit, a wrench unit and a rotation handle; wherein:

the wrench unit includes:

a threaded rod having a first end connected with the oneway control unit;

an adjusting member mounted on the threaded rod;

a base member connected with the oneway control unit; and a clamping member extending through the base member and connected with the adjusting member;

the base member is provided with a receiving recess and two passages;

the receiving recess of the base member has a first side provided with a resting wall and a second side provided with a receiving space;

the clamping member has two distal ends extending through the two passages of the base member and secured to the adjusting member;

the oneway control unit is received in the receiving recess of the base member and mounted on the first end of the threaded rod;

the rotation handle is secured on a second end of the threaded rod;

the oneway control unit includes:

a control member mounted on the first end of the threaded rod and having a first side provided with a drive portion abutting the resting wall of the base member and a second side provided with a mounting portion;

a toothed member mounted on the control member; and an elastic member mounted on the mounting portion of the control member; and the control member has a top provided with a push portion abutting an inner top edge of the toothed member;

the receiving space of the base member has an upper portion provided with a resting wall;

the toothed member has a side provided with an abutting portion abutting the resting wall of the base member; and the toothed member is located above the control member and received in the receiving recess of the base member.

5. The oil core wrench of claim 4, wherein the elastic member has a first end mounted on the mounting portion of the control member and a second end abutting an inner wall of the receiving space of the base member.

6. The oil core wrench of claim 4, wherein:

the oneway control unit further includes a shaft extending through the base member and the control member;

the base member is provided with a through hole connected to the receiving recess;

the control member is provided with a transverse bore; and the shaft extends through the through hole of the base member and the transverse bore of the control member so that the control member is pivotally mounted in the receiving recess of the base member.

* * * * *